US009691576B2

(12) United States Patent
Mitschele et al.

(10) Patent No.: US 9,691,576 B2
(45) Date of Patent: Jun. 27, 2017

(54) TEMPERATURE-DEPENDENT SWITCH

(71) Applicant: Thermik Geraetebau GmbH, Sondershausen (DE)

(72) Inventors: Rainer Mitschele, Straubenhardt (DE); Hans-Christian Liehr, Sangerhausen (DE)

(73) Assignee: THERMIK GERAETEBAU GMBH, Sondershausen (DE)

( * ) Notice: Subject to any disclaimer, the term of this patent is extended or adjusted under 35 U.S.C. 154(b) by 198 days.

(21) Appl. No.: 14/339,570

(22) Filed: Jul. 24, 2014

(65) Prior Publication Data

US 2015/0042443 A1 Feb. 12, 2015

(30) Foreign Application Priority Data

Aug. 7, 2013 (DE) ..... 10 2013 108 508

(51) Int. Cl.
*H01H 37/34* (2006.01)
*H01H 37/54* (2006.01)
*H01H 1/50* (2006.01)

(52) U.S. Cl.
CPC ..... *H01H 37/34* (2013.01); *H01H 1/504* (2013.01); *H01H 37/54* (2013.01); *H01H 37/5427* (2013.01)

(58) Field of Classification Search
CPC .... H01H 37/34; H01H 1/504; H01H 37/5427; H01H 37/54
USPC ..... 337/298, 365
See application file for complete search history.

(56) References Cited

U.S. PATENT DOCUMENTS 4,849,729 A * 7/1989 Hofsass ..... H01H 37/5427 337/102
4,862,132 A * 8/1989 Hollweck ..... H01H 37/54 337/102
5,023,744 A * 6/1991 Hofsass ..... H01H 1/504 337/365
5,615,072 A 3/1997 Hofsäss et al.
5,721,525 A 2/1998 Hofsäss
5,745,022 A 4/1998 Becher et al.
5,757,261 A * 5/1998 Becher ..... H01H 11/0006 337/104

(Continued)

FOREIGN PATENT DOCUMENTS

DE 21 21 802 A 1/1973
DE 26 44 411 A1 4/1978

(Continued)

OTHER PUBLICATIONS

European Search Report dated Apr. 20, 2015; 4 pp.

*Primary Examiner* — Anatoly Vortman
(74) *Attorney, Agent, or Firm* — Harness, Dickey & Pierce, P.L.C.

(57) ABSTRACT

A temperature-dependent switch has a temperature-dependent switching mechanism, a housing accommodating the switching mechanism, two first connections between which first connections the switching mechanism makes or interrupts an electrically conductive connection depending on the temperature of said switching mechanism, and a heating resistor that is arranged on an outside of the housing and is connected electrically in series with the two connections. The heating resistor is a sheet-like metal part that is welded to the housing and carries a further connection.

21 Claims, 6 Drawing Sheets

(56) References Cited

U.S. PATENT DOCUMENTS

| | | | | | |
|---|---|---|---|---|---|
| 5,835,001 | A * | 11/1998 | Hofsass | H01H 1/504 | 337/104 |
| 5,864,279 | A * | 1/1999 | Becher | H01H 37/5427 | 337/333 |
| 5,877,671 | A | 3/1999 | Hofsäss | | |
| 5,892,429 | A * | 4/1999 | Hofsass | H01H 1/504 | 337/102 |
| 5,903,210 | A * | 5/1999 | Hofsass | H01H 37/64 | 337/333 |
| 5,949,322 | A | 9/1999 | Radbruch et al. | | |
| 5,973,587 | A * | 10/1999 | Hofsass | H01H 1/504 | 337/333 |
| 6,133,817 | A | 10/2000 | Hofsäss et al. | | |
| 6,249,211 | B1 | 6/2001 | Hofsaess | | |
| 6,542,062 | B1 | 4/2003 | Herrick | | |
| 8,284,011 | B2 * | 10/2012 | Hofsaess | H01H 37/04 | 29/622 |
| 2007/0252671 | A1 | 11/2007 | Bischoff et al. | | |
| 2013/0271258 | A1 | 10/2013 | Hofsaess et al. | | |

FOREIGN PATENT DOCUMENTS

| | | | |
|---|---|---|---|
| DE | 41 42 716 | A1 | 6/1993 |
| DE | 43 36 564 | C2 | 5/1994 |
| DE | 44 28 226 | C1 | 10/1995 |
| DE | 195 09 656 | A1 | 9/1996 |
| DE | 195 14 853 | A1 | 11/1996 |
| DE | 196 23 570 | C2 | 1/1998 |
| DE | 198 16 807 | A1 | 10/1999 |
| DE | 195 17 310 | A1 | 12/1999 |
| DE | 198 27 113 | A1 | 12/1999 |
| DE | 10 2004 036 117 | A1 | 3/2006 |
| DE | 10 2008 031 389 | B3 | 10/2009 |
| DE | 10 2011 016 896 | B3 | 8/2012 |
| DE | 10 2011 016 133 | B4 | 10/2012 |
| DE | 10 2012 103 306 | B3 | 4/2013 |
| EP | 0 756 301 | A2 | 1/1997 |
| EP | 2 506 281 | A1 | 10/2012 |
| GB | 1 394 612 | | 5/1975 |

* cited by examiner

TEMPERATURE-DEPENDENT SWITCH

RELATED APPLICATION

This application claims priority to German patent application DE 10 2013 108 508, filed Aug. 7, 2013, which is incorporated herein by reference.

BACKGROUND OF THE INVENTION

Field of the Invention

The present invention relates to a temperature-dependent switch comprising a temperature-dependent switching mechanism, a housing accommodating the switching mechanism, two first connections provided on the switch, between which first connections the switching mechanism makes or opens an electrically conductive connection depending on the temperature of said switching mechanism, and comprising a heating resistor, which is arranged on an outside of the housing and is connected electrically in series with the two first connections.

Related Prior Art

Such a switch is known from DE 43 36 564 C2.

The known switch is embodied in the form of an encapsulated switch comprising a two-part, current-conducting metal housing, as is known, for example, from DE 21 21 802 A or DE 196 23 570 C2 as well. The encapsulated switch is arranged on a mounting plate consisting of ceramic, on which mounting plate a thick-film resistor is arranged between conductor tracks, which thick-film resistor is electrically connected at one of its ends to the conductive lower part of the encapsulated switch. The other end of this heating resistor is connected to one of the conductor tracks, which acts as the soldering surface to which a first connection strand is soldered. The second connection strand is electrically soldered to the conductive cover part of the encapsulated switch.

The lower part of the switch rests with its outer base on the heating resistor. The thick-film resistor can in this case be covered by an insulating layer. The switch is intended to be soldered to a lateral conductor track on the mounting plate, wherein no mention is made in this document of how the soldering is intended to take place. As a result, a linear cohesive contact is produced between the lower part and the conductor track acting as soldering surface.

It is not only problematic to produce this connection, additionally it also has insufficient mechanical stability, for which reason the document discloses that heat-shrink tubing is shrunk onto the switch and the mounting plate together, and the two connection strands protrude out of said heat-shrink tubing laterally. As a result, the switch and the mounting plate are additionally mechanically fixed to one another specification.

Such temperature-dependent switches are used in a known manner for protecting electrical appliances from overheating. For this purpose, the switch is connected electrically in series with the appliance to be protected via its two first connections and is arranged mechanically on the appliance in such a way that it is thermally connected thereto.

In the embodiment of a switch in accordance with DE 196 23 570 C2, a temperature-dependent switching mechanism comprising a spring disc, a bimetallic snap-action disc and a movable contact part is arranged in the housing, which movable contact part is in bearing contact with a stationary contact part on the inside on the upper part in the closed state of the switch, which stationary contact part is through-plated towards the outside to a first connection on the upper part. The conductive lower part acts as further first connection.

The operating current of the appliance to be protected thus flows through the two contact parts and the spring disc into the lower part.

The switch known from DE 43 36 564 C2, by virtue of the heating resistor, is equipped with a current-dependent switching function, for which purpose the heating resistor is connected permanently electrically in series with the first connections. The operating current of the appliance to be protected therefore flows continuously through this heating resistor, which can be dimensioned such that, in the event of a specific operating current being exceeded, it ensures that the bimetallic snap-action disc is heated to a temperature above its response temperature, with the result that the switch opens at a high operating current even before the appliance to be protected has heated to an impermissible extent.

Below the response temperature of the bimetallic snap-action disc, the circuit is closed and the appliance to be protected is supplied with current via the switch. If the temperature increases beyond a permissible value, either as a result of an excessively high operating current or as a result of an excessively heated appliance to be protected, the bimetallic snap-action disc deforms, as a result of which the switch is opened and the supply to the appliance to be protected is interrupted.

The now de-energized appliance can then cool down again. In the process, the switch which is thermally coupled to the appliance also cools down again, which switch thereupon closes again automatically. While such a switching response may be quite sensible for protecting a hairdryer, for example, this is not always desirable when the appliance to be protected should not automatically switch on again after shutdown in order to avoid damage. This applies, for example, to electric motors which are used as drive assemblies.

In known temperature-dependent switches, therefore, a so-called self-holding resistor is often provided, which is electrically in parallel with the first connections; see, for example, DE 195 14 853 A1. The self-holding resistor is electrically in series with the appliance to be protected when the switch is open, and now only a harmless residual current flows through the appliance owing to the resistance value of the self-holding resistor. This residual current is sufficient, however, to heat up the self-holding resistor to such an extent that it emits heat, which keeps the bimetallic snap-action disc above its switching temperature.

As a deviation from the embodiment of the switch in accordance with DE 196 23 570 C2, the temperature-dependent switching mechanism can also comprise only a bimetallic snap-action disc, which supports the movable contact part and therefore conducts the operating current.

The switching mechanism can also comprise a bimetallic spring tongue, as is described in DE 198 16 807 A1. This bimetallic spring tongue supports, at its free end, a movable contact part, which interacts with a stationary counter contact. The stationary counter contact is electrically connected to one of the first connections, wherein the other first connection is electrically connected to the clamped-in end of the bimetallic spring tongue. The bimetallic spring tongue in this case conducts the operating current of the electrical appliance to be protected.

If the temperature-dependent switch is intended to conduct particularly high currents, a current transfer element in the form of a contact bridge or a contact plate is often used, which is moved by a spring part and supports two contact parts, which interact with two stationary counter contacts.

In this way, the operating current of the appliance to be protected flows from the first counter contact via the first contact part into the contact plate, through said contact plate to the second contact part and from there into the second counter contact. The spring part is thus de-energized. It is also known to use the spring part itself, i.e. for example a bimetallic snap-action disc or a spring snap-action disc operating against a bimetallic part as contact bridge.

In particular when the known switches are used for protecting high-power motors, they need to be able to be subjected to a very high mechanical load owing to the severe vibrations occurring during operation and in particular during run-up of the motors.

In addition, the switches need to be capable of protecting the motors reliably both during critical operation at the maximum permissible power and in the case of a locked rotor. In order to check whether the switch also achieves this, two tests are implemented in a conventional manner.

In the so-called Heating Test, the motor is operated at maximum power, wherein neither the current flow through the switch nor the heat transmitted in the process from the motor to the switch should open the switch.

In the so-called Locked Rotor Test, on the other hand, the motor is connected to the operating voltage when the rotor is locked, which results in an operating current flowing through the motor which is three to five times higher than the conventional operating current.

This high current naturally also results in heating of the motor and therefore in a temperature increase at the switch.

However, this heating-up takes place so slowly that the motor may already be irreversibly destroyed before the switch responds as a result of the increase in the motor temperature. Therefore, in this test a heating resistor needs to ensure that the switch opens very quickly.

Even in the case of suitable matching between the response temperature of the bimetallic snap-action disc and the resistance value of the heating resistor on its own, these two contradictory conditions cannot be met in the above-described known switches, however.

These values could indeed be set such that the maximum permissible operating current does not result in the heating resistor heating the bimetallic snap-action disc to a temperature above its switching temperature but such that this only takes place as a result of the markedly higher current in the case of a locked rotor.

Secondly, the response temperature of the bimetallic snap-action disc could be selected such that it is above the temperature which is assumed by the motor during operation at maximum permissible power and which is transferred to the switch, but below the temperature to which the bimetallic snap-action disc is heated by the heating resistor when the current flows through it when the rotor is locked.

The switching response set in this way is only achieved during the steady-state operation, however, i.e. if sufficient time has lapsed in order for the switch to open, either when the temperature of the motor is too high or else when the current is too high. For the protection of a high-power motor, however, it is also necessary for the switch to respond extremely quickly, in particular in the case of a locked rotor.

This requires very good thermal coupling of the heating resistor to the switch in order that a change in the temperature of the heating resistor is transmitted to the bimetallic snap-action disc in the shortest possible time.

In addition to good thermal coupling, the switch also needs to perform the required number of switching cycles, which should be at least 3000 in the case of typical requirements, such as have been described above. For relatively low operating currents up to approximately 4 amperes and switching temperatures of approximately 160° C., the known switches meet these requirements as well.

In the case of relatively high operating currents of 10 amperes or more, the number of switching cycles is markedly reduced, however, because the temperature change at the soldered joints between the lower part and the mounting plate result in the soldered joints being damaged as a result of fatigue failure after approximately 1000 switching cycles to such a great extent that the current flow is interrupted and the switch is not operational.

DE 10 2011 016 133 B4 therefore proposes, in contrast to the embodiment disclosed in DE 43 36 564 C2 cited at the outset, to solder the bottom of the switch and not only the lateral transition between the bottom and the side wall onto the mount flat.

The bottom of the switch is used here for two purposes, firstly it rests over the full area on the heating resistor, and secondly it is held flat on the soldering surface by means of a cohesive joint. By virtue of this flat cohesive joint, next to the heating resistor, a very good thermal connection of the switch to the heating resistor results, wherein the switch is not only fixed mechanically very stably to the mounting plate in this way, but this type of fixing also results in the desired thermal coupling.

With this known switch, the design described to this extent entails the risk that, when handled improperly, a force is exerted on the mounting plate and/or the housing, which force results in the soldered joints breaking or at least being weakened.

SUMMARY OF THE INVENTION

In view of this prior art, it is one object of the present invention to develop the switch mentioned at the outset such that, given a simple and inexpensive design, good thermal coupling of the heating resistor to the switch and at the same time a good mechanical hold between the switch and the heating resistor is realized.

In accordance with the invention, this and other objects are achieved in the case of the switch mentioned at the outset in that the heating resistor is embodied in the form of a sheet-like metal part, which is welded to the housing, wherein a further connection is provided on the metal part.

By virtue of welding a heating resistor in the form of a sheet-like metal part, a mechanically very stable connection between the housing and the heating resistor is ensured which, according to first tests on the applicant's premises, do not demonstrate any fatigue failure even after more than 3000 switching cycles on operating currents of 20 or 30 amperes.

By virtue of the welding, the thermal connection of the heating resistor to the housing is realized in a manner which is simple in design terms and inexpensive. If the housing is electrically conductive where the heating resistor is welded, the electrical connection to one of the two first connections is also produced at the same time by the welding when the conductive housing either already acts as one of the first connections or, in accordance with the invention, is connected to one of the first connections. The other first connection of the switch and a further connection provided on the heating resistor are then used for the external connection of the switch, for example by soldering on connection strands.

"First connections" are understood within the scope of the present invention as meaning the two connections of a switch via which it is electrically connected to an appliance to be protected if it is not provided, in accordance with the invention, with an outer metal part, which acts as heating resistor and provides a further connection.

It is among others advantageous here that the heating of the housing by the flowing operating current takes place with the aid of a welded-on metal part, as a result of which the Joule heat is distributed away from the switching contact points towards the housing and the switching mechanism.

By virtue of the welding, the metal part is corrugated, which at first glance would suggest that the use of a metal part welded to the outside of the housing would not be appropriate. However, this resultant corrugated formation makes it possible, according to the findings of the inventors, to use thin metal parts because the current and the heat transfer from the heating resistor—formed by the metal part—into the housing takes place not over a large area via the entire metal part but via the welding spots.

With the outer metal part, switches with or without a self-holding function can be provided with a defined current sensitivity.

A "sheet-like metal part" is understood within the scope of the present invention as meaning a flat and thin metal plate consisting of a suitable metal or a suitable metal alloy with a corresponding electrical conductivity which can be produced in the same way as a sheet-metal part, in particular a thin metal sheet, by rolling from suitable blanks. The sheet-like metal parts can also be produced in another way, however. The sheet-like metal part used in accordance with the invention can also be referred to simply as sheet-metal part.

According to one object, the housing is designed to be electrically conductive at least in one section, which is electrically connected to one of the first connections, wherein the sheet-metal or metal part is welded to the electrically conductive section, or if the housing is designed to be electrically conductive as a whole.

It is advantageous here that, owing to the welding operation, both the thermal and the electrical connection to the switch is performed, which contributes to low manufacturing costs. The invention can therefore be used for all switches which have at least one current-conducting housing part or an electrically conductive housing or housing part, to which one of the first connections is or can be connected.

The invention can therefore be used in existing switches without the design of the switches needing to be changed as such.

According to a further object, the metal part is welded to the housing at at least two welding spots. According to a still further object, a connection piece is welded to the metal part as further connection, and according to another object, the connection piece is welded to the metal part at at least two welding spots.

By virtue of spot-welding spots, the metal part can be fastened to the housing in a simple and inexpensive manner, wherein the electrical and thermal connections are defined by the welding spots, which is advantageous in particular when setting the resistance value of the metal part. The operating current and the Joule heat are therefore conducted into the housing through the point-like welding spots.

According to another object, the metal part protrudes with a section beyond the housing, on which section the further connection is provided, wherein the further connection can also be arranged centrally or in another way on the metal part.

The further connection can therefore either be within the contour of the housing or laterally next to the bottom or cover or above or below the housing. Depending on the respective application cases, starting from the metal part welded to the housing on the outside in accordance with the invention, the position of one of the external connections can therefore be selected as desired in a manner which is simple in design terms and inexpensive.

According to one object, the metal part has an ohmic resistance value of less than 100 mΩ, preferably between 2 and 50 mΩ, as measured between the further connection and the housing or the welding spots, wherein preferably the metal part has a thickness of at least 50 μm.

At the envisaged operating currents in the region of 10 amperes or higher, according to the knowledge of the inventors of the present application good current sensitivities are achieved with these values.

With the given dimensions for temperature-dependent switches and the resultant dimensions of the sheet-like metal parts, these resistance values can be set if, for example, spring steel strip, for example material no. 1.4310, or resistance alloys, for example Isachrom 2.4867, are used as sheet-metal part.

According to one embodiment, the switching mechanism comprises a bimetallic snap-action disc, which is mechanically connected to a movable contact part and, below its switching temperature, presses said movable contact part against a stationary contact part and, above its switching temperature, lifts off said movable contact part from said stationary contact part, wherein the stationary contact part is connected to one of the first connections, and the switching mechanism is connected to the other first connection at least when the contact parts rest on one another.

According to another embodiment, a spring snap-action disc is provided which preloads the movable contact part for resting on the stationary contact part and also a bimetallic snap-action disc is provided which lifts off the movable contact part from the stationary contact part above the switching temperature of said bimetallic snap-action disc, wherein, in addition, preferably the spring snap-action disc is arranged between the stationary contact part and the bimetallic snap-action disc.

While it is quite sufficient if only a bimetallic snap-action disc is provided, which both conducts the operating current and produces the contact pressure and ensures temperature-dependent opening, by virtue of a spring snap-action disc, which, in addition to the bimetallic snap-action disc or on its own, effects the contact pressure, the bimetallic snap-action disc can be relieved of mechanical and electrical load in its low-temperature position, which contributes to greater long-term stability of its switching response.

According to a further embodiment, the switching mechanism comprises a current transfer element, which interacts with two stationary contact parts which are each connected to one of the first connections, wherein preferably one of the first connections is electrically connected to the housing, further preferably the switching mechanism comprises a bimetallic snap-action disc, which is mechanically connected to the current transfer element and presses said current transfer element against the two stationary contact parts below the switching temperature of said bimetallic snap-action disc and lifts said current transfer element off from said stationary contact parts above the switching temperature of said bimetallic snap-action disc, and further preferably the switching mechanism has a spring disc, which preloads the current transfer element for resting against the stationary contact parts, wherein the bimetallic snap-action disc lifts off the current transfer element from the stationary contact parts above the switching temperature of said bimetallic snap-action disc.

It is advantageous here that the switch can conduct much higher currents than the above-mentioned switch in which the current is passed through the bimetallic snap-action disc or through the spring snap-action disc. This is particularly advantageous if the switch is used for operating high-power electric motors that require high operating currents.

Temperature-dependent switches comprising a current transfer element that interacts with two stationary contact parts are known, for example, from DE 26 44 411 A1. In these switches, the two stationary contact parts that are arranged in the upper part are connected in series with the supply current to the appliance to be protected, with the result that the current flows through the current transfer element when the switch is at a temperature below the switching temperature.

The current transfer element can be a separate contact plate; however, it is also possible in individual cases for the bimetallic snap-action disc or the spring snap-action disc to be used as current transfer element.

In order to be able to make use of the heating resistor in the form of a metal part, as already described above, and the associated advantages, one of the two first connections is electrically connected to the electrically conductive lower part, which is in turn connected to the heating resistor which is connected to the further connection. As a result, the current flows from the further connection through the heating resistor into the lower part and from there via one first connection to the second stationary contact part, from there through the current transfer element to the first stationary contact part and then via the first contact part to the other first connection.

By virtue of the interconnection, which at first glance is unconventional, between the second contact part or one first connection and the lower part, it is therefore possible to make use of the advantages of the heating resistor in the form of a metal part even for switches in which the operating current is originally not passed via the housing, but whose housing is electrically conductive, at least in a section which is generally the lower part.

The design of the heating resistor as a metal part in accordance with the invention can therefore be used in all temperature-dependent switches that have an electrically conductive housing part, to which the metal part can be welded. The temperature-dependent switching mechanism can be designed as desired as long as it ensures that it produces or opens, depending on its temperature, an electrically conductive connection between the electrically conductive housing part, which acts as one of the first connections or, in accordance with the invention, is connected to one of the first connections, and the other first connection.

In another configuration of a switch in which the housing of the switch does not conduct the operating current when said switch has not yet been provided with the metal part, the switch has an insulating base, on which the two first connections are arranged and onto which the housing is plugged, wherein preferably one of the two first connections is electrically connected to the housing.

The switch can in each case additionally be provided with a self-holding resistor in order that the open switch does not cool down and close again automatically.

Further advantages result from the description and the attached drawing.

It goes without saying that the features mentioned above and yet to be explained below can be used not only in the respectively cited combination, but also in other combinations or on their own without departing from the scope of the present invention.

BRIEF DESCRIPTION OF THE DRAWINGS

Embodiments of the invention are illustrated in the attached drawing and will be explained in more detail in the description below. In the drawing.

DESCRIPTION OF PREFERRED EMBODIMENTS

Figure 1:
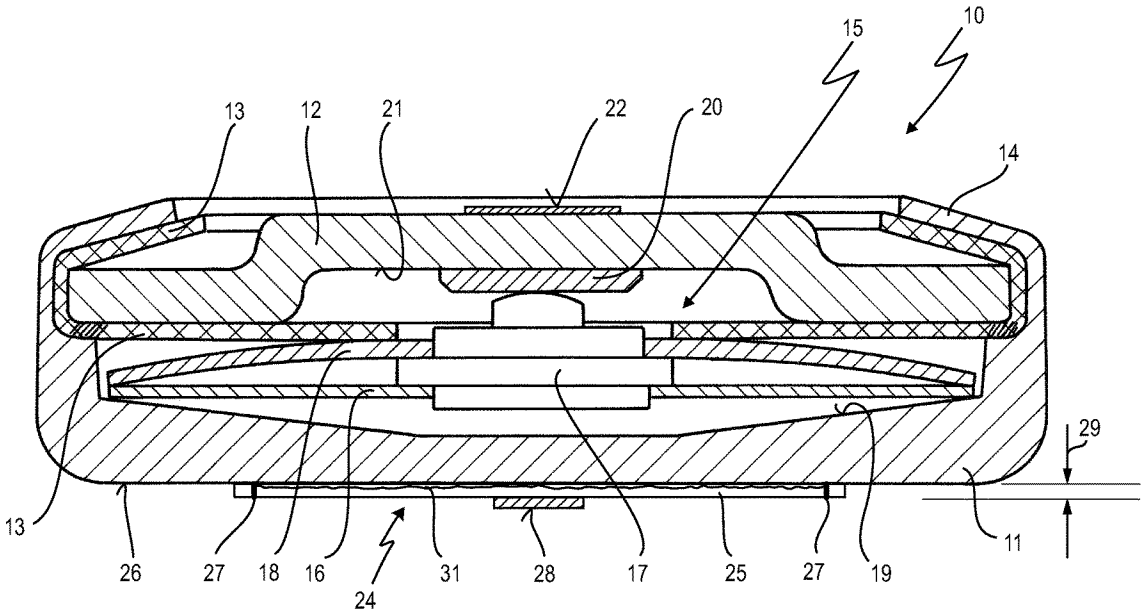
FIG. 1 shows a schematic longitudinal section, which is not true to scale, through a temperature-dependent switch, in which a movable contact part interacts with a stationary contact part, and a heating resistor is welded on the outside of the housing of said switch.

In FIG. 1, 10 denotes a temperature-dependent switch which comprises a pot-like lower part 11, which is closed by an upper part 12, which is held on the lower part 11—with an insulation film 13 interposed—by a flanged rim 14.

A temperature-dependent switching mechanism 15 which comprises a spring snap-action disc 16, which centrally supports a movable contact part 17 on which a freely inserted bimetallic disc 18 rests, is arranged in the housing of the switch 10, which housing is formed by the lower part 11 and the upper part 12.

The spring snap-action disc 16 is supported on an inner bottom 19 on the inside on the lower part 11, which is manufactured from electrically conductive material.

The movable contact part 17 is in bearing contact with a stationary contact part 20, which is provided on an inner side 21 of the upper part 12, which in this embodiment is likewise manufactured from metal, although it is sufficient for the embodiment of the invention if the housing is electrically conductive at least in one section, i.e. if in the case of the switch 10 at least the lower part 11 is electrically conductive.

In this way, the temperature-dependent switching mechanism 15 in the low temperature position shown in FIG. 1 produces an electrically conductive connection between the upper part 12 and the lower part 11, wherein the operating current flows via the stationary contact part 20, the movable contact part 17 and the spring snap-action disc 16.

Alternatively, it is also possible to use instead of the spring snap-action disc 16 a bimetallic part that supports the movable contact part 17 and therefore conducts the operating current when the switch 10 is closed.

If, in the case of the switch 10 shown in FIG. 1, the temperature of the bimetallic disc 18 increases beyond its response temperature, it snaps over from the convex position shown in FIG. 1 into its concave position, in which it lifts off the movable contact part 17 from the stationary contact part 20 counter to the force of the spring disc 16 and therefore opens the circuit.

Such a temperature-dependent switch 10 is known, for example, from DE 196 23 570 A1, the content of which is hereby made the subject matter of the present disclosure.

In the case of the switch shown in FIG. 1, a contact surface in a central region of the upper part 12 acts as a first connection 22. The lower part 11, with which contact can be made, for example, via the rim 14 or a bottom 26, acts as further first connection.

The switch 10 is equipped with a heating resistor 24 in the form of a metal part, which is welded from outside onto the outer bottom 26 of the lower part 11 and is electrically in series with the first connections.

In the embodiment shown, the metal part 25 is welded to the outer bottom 26 at four welding spots 27, which preferably takes place by means of resistance welding. Two of the four welding spots 27 are shown in FIG. 1.

A contact surface that acts as further connection 28 for the switch 10 is provided centrally on the metal part 25.

In a known manner, one connection lug can be soldered with its respective inner end onto each of the connections 22, 28, which connection lugs are then used for interconnection with an appliance to be protected. For this purpose, welding angles can be welded to the connections 22, 28.

It is also possible to solder connection strands to the connections 22, 28.

The metal part 25 has an ohmic resistance value in the milliohms range between the connection 28 and—via the welding spots 27—the lower part 11.

Any electrically conductive sheet-like metal part which has the corresponding resistance value given the dimensions possible here can be used as metal part, as will be explained in more detail below.

Via the welding spots 27, the metal part 25 is connected both electrically and thermally to the lower part 11. During welding, the metal part 25, which in the embodiment shown has a thickness indicated at 29 of 50 μm, becomes corrugated to such an extent that only the welding spots 27 contribute to the electrical and thermal contact to the lower part 11. The resultant corrugated nature is indicated at 31 in FIG. 1.

The metal part 25 could also be welded laterally to the conductive lower part 11 if the bottom 26 is intended to be kept free as heat transfer surface.

Alternatively, it would also be possible to weld the metal part 25 from outside onto the electrically conductive cover part 12, with the result that the connection 22 would be electrically in series with the connection 28 via the heating resistor 24. Then, for example, the rim 14 or the bottom 26 of the lower part 11 would be available as second connection.

If necessary, an insulation layer can be arranged between the bottom 26 and the metal part 25. In the case of the switches 10 according to the invention produced and tested previously on the applicant's premises, this was not required, however.

If desirable, the switch 10 can also be provided with a self-holding function, i.e. have a further resistor which is connected electrically in parallel with the first connections. For this, for example, the cover part 12 is manufactured from PTC thermistor material, in which case the insulation film 13 is dispensed with without being replaced, with the result that the PTC thermistor forming the cover part 12 is electrically connected to the two first connections 22 and 11/14. Such a switch is described in DE 195 17 310 A1.

Alternatively, a self-holding resistor in the form of a thick-film resistor can also be arranged on the cover part, as is described by way of example in DE 195 14 853 A1. In the switch known from this document, the self-holding resistor is applied to the insulation film 13.

Figure 2:
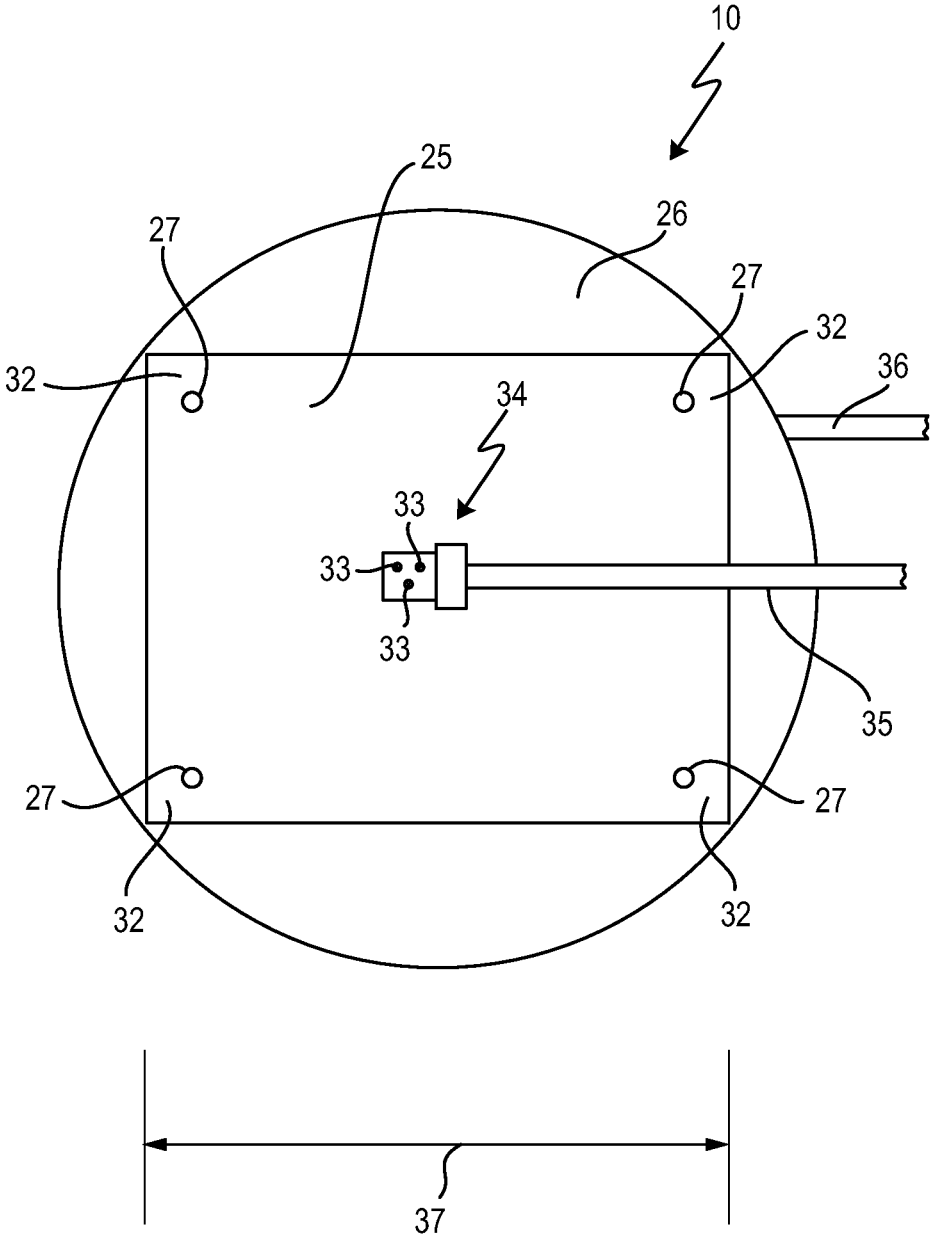
FIG. 2 shows a schematic view of the switch shown in FIG. 1 from below with a view of the heating resistor.

FIG. 2 shows a view of the circular bottom 26 of the switch 10 shown in FIG. 1. It can be seen that the four welding spots 27 are fitted in the four corners 32 of the metal part 25.

A welding angle 34 is fastened on the metal part 25 centrally with three welding spots 33, with a connection strand 35 being welded to said welding angle. Also shown is a second connection strand 36, which is electrically connected to one first connection 22.

The square metal part 25 has edge lengths 37 of 10 mm, which, given a thickness 29 of 50 μm, results in a resistance value of approximately 10 mΩ between the connection strand 35 and, via the welding spots 27 and 33, the bottom 26 when a metal part consisting of spring steel strip of material no. 1.4310 is used.

Long-time tests have confirmed that on a DC voltage drop of 14 volts such a switch 10 withstands an operating current of 25 A at a switch-off temperature of 160° C. for more than 3500 switching cycles without any impairment to the operation. For a short period of time, the switch 10 also withstands an operating current of 35 A at a switch-off temperature of 400° C.

The metal part 25 can also have any other geometric shape, in particular the welding angle 34 can also be welded onto the metal part eccentrically. The metal part 25 can be rectangular, triangular, round, circular, oval or drop-shaped, for example, wherein the welding angle 34 or a connection piece formed as desired can be welded centrally or to the rim of the metal part 25, which can also protrude laterally beyond the base 26.

It is merely important that the metal part, measured between the further connection 28 or in this case the welding angle 34 and the housing, has an ohmic resistance value of less than 100 ma preferably of approximately 10 mΩ.

Figure 3:
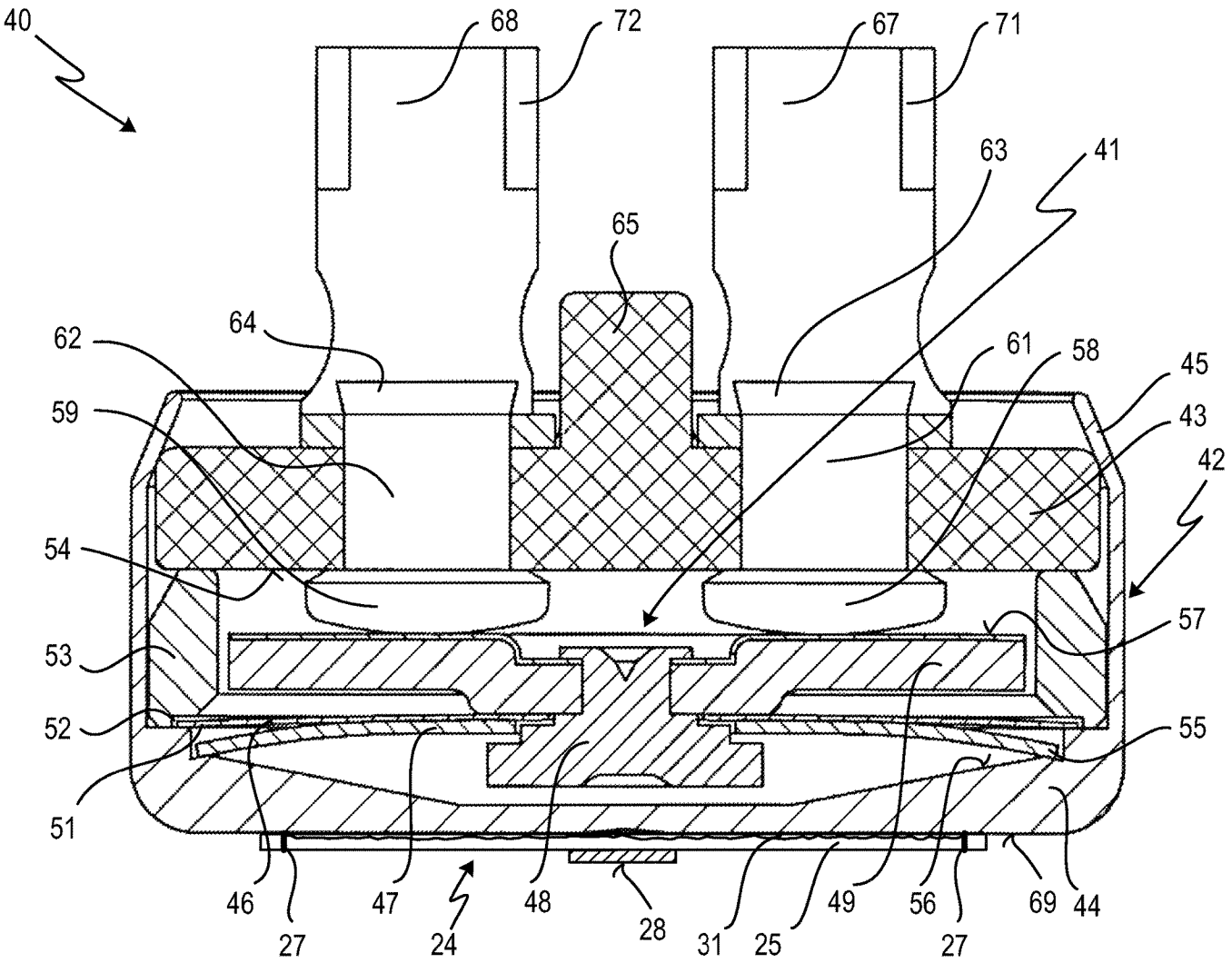
FIG. 3 shows, in an illustration as shown in FIG. 1, a further temperature-dependent switch, in which two stationary contact parts interact with a current transfer element.

In FIG. 3, 40 denotes a further temperature-dependent switch, which, in the same way as the switch 10 shown in FIG. 1, is provided with a heating resistor formed by a metal part.

The switch 40 comprises a temperature-dependent switching mechanism 41, which is accommodated in a housing 42. The housing 42 has an upper part 43 that is manufactured from an insulation material and closes an electrically conductive lower part 44, whose rim 45 fixes the upper part 43 to the lower part 44.

Within the meaning of the present invention, in this case it is the lower part 44 that forms the electrically conductive section of the housing 42, onto which the metal part 25 is welded.

The switching mechanism 41 comprises a spring snap-action disc 46 and a bimetallic snap-action disc 47, with a pin-like rivet 48 passing centrally through said bimetallic snap-action disc 47 and said spring snap-action disc 46, by means of which rivet said discs are mechanically connected to a current transfer element 49 in the form of a contact plate.

The spring snap-action disc 46 is clamped in with its rim 51 between a circumferential shoulder 52 internally in the lower part 44 and a spacer ring 53, on which the upper part 43 rests with its inner side 54.

The bimetallic snap-action disc 47 is supported with its rim 55 on an inner bottom 56 of the lower part 44.

The round, in the present case circular, current transfer element 49 has, in the direction of the upper part 43, an electrically conductive contact surface 57, which runs peripherally in the circumferential direction and interacts with two stationary contact parts 58, 59, which are arranged on the inner side 54 of the upper part 43.

The stationary contact parts 58, 59 are in the form of inner heads of contact rivets 61, 62, which pass through the upper part 43 and end in outer sections 63, 64. An insulating web 65 is provided between the sections 63, 64.

In each case one connection piece 67 or 68 with lugs 71 and 72, respectively, which each act as first connections of the switch 40, is arranged on the two outer sections 63, 64 of the contact rivets 61, 62.

The lower part 44 has an outer bottom 69, to which the metal part 25 forming the heating resistor 24 is welded with four welding spots 27, as has been described above already for the switch 10.

FIG. 3 again shows the corrugated nature 31 formed during welding and the connection 28.

The metal part 25 could also in this case be welded laterally to the conductive lower part 44 when the bottom 69 is intended to be kept free as heat transfer surface.

If appropriate, prior to welding of the metal part 25 to the bottom 69, the welding angle 34 is also welded to the connection 28, as has been described in FIG. 2. In the view from below, the switch 30 thus has the same appearance as the switch 10, with the result that reference is made in this regard to FIG. 2, so as to avoid repetition.

In order to provide the switch 40 with connection strands, the upper, u-shaped lugs 71, 72 are bent back downwards onto the sections 63 and 64, respectively, and generally ends of the connection strands from which the insulation has been stripped are inserted into the "tunnel" thus formed and soldered.

Figure 4:
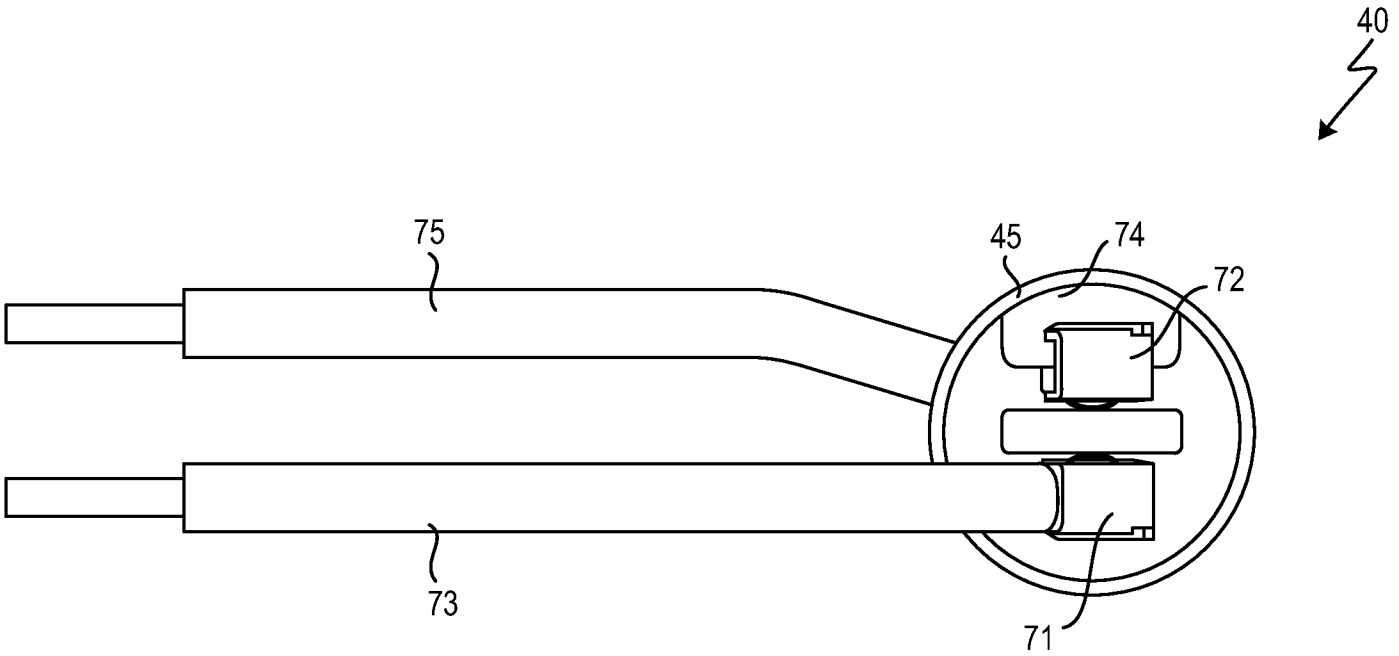
FIG. 4 shows the switch provided with connection strands shown in FIG. 3 in plan view.

In the present case, however, a connection strand 73 is only soldered to the lug 71, as can be seen in the plan view in FIG. 4.

The lug 72 assigned to the second stationary contact part 59 is electrically connected to a connecting part 74 in a comparable manner, which connecting part 74 is connected to the conductive lower part 44 over the rim 45 thereof. In the simplest case, the connecting part 74 is formed by soldering compound, which electrically and mechanically connects the rim 45 to the connection piece 68.

In this way, the stationary contact part 59 is connected to the electrically conductive lower part 44, which is connected to the heating resistor 24 via the welding spots 27, to which heating resistor a second connection strand 75 is connected via the welding angle 34, as is indicated in the plan view shown in FIG. 4. The heating resistor 24 is thus connected electrically in series with the stationary contact part 59.

If the current transfer element 49 in FIG. 3 is in bearing contact with the two stationary contact parts 58, 59, there is therefore a continuous electrically conductive connection from the first connection strand 73 via the connection piece 67 to the first stationary contact part 58, from there via the current transfer element 49, the second stationary contact part 59, the second connection piece 68 and the connecting part 74 to the rim 45 and from there to the lower part 44, which is connected to the second connection strand 75 via the heating resistor 24.

If the cover part 43 is manufactured from PTC thermistor material, the PTC thermistor thus formed is in parallel with the first connections 71, 72 and provides a self-holding function, as is known from DE 198 27 113 A1.

Alternatively, in accordance with DE 198 27 113 A1, the self-holding resistor can also be provided on the cover part 43 manufactured from insulating material on the inside or on the outside, for example formed as a thick-film resistor.

Figure 5:
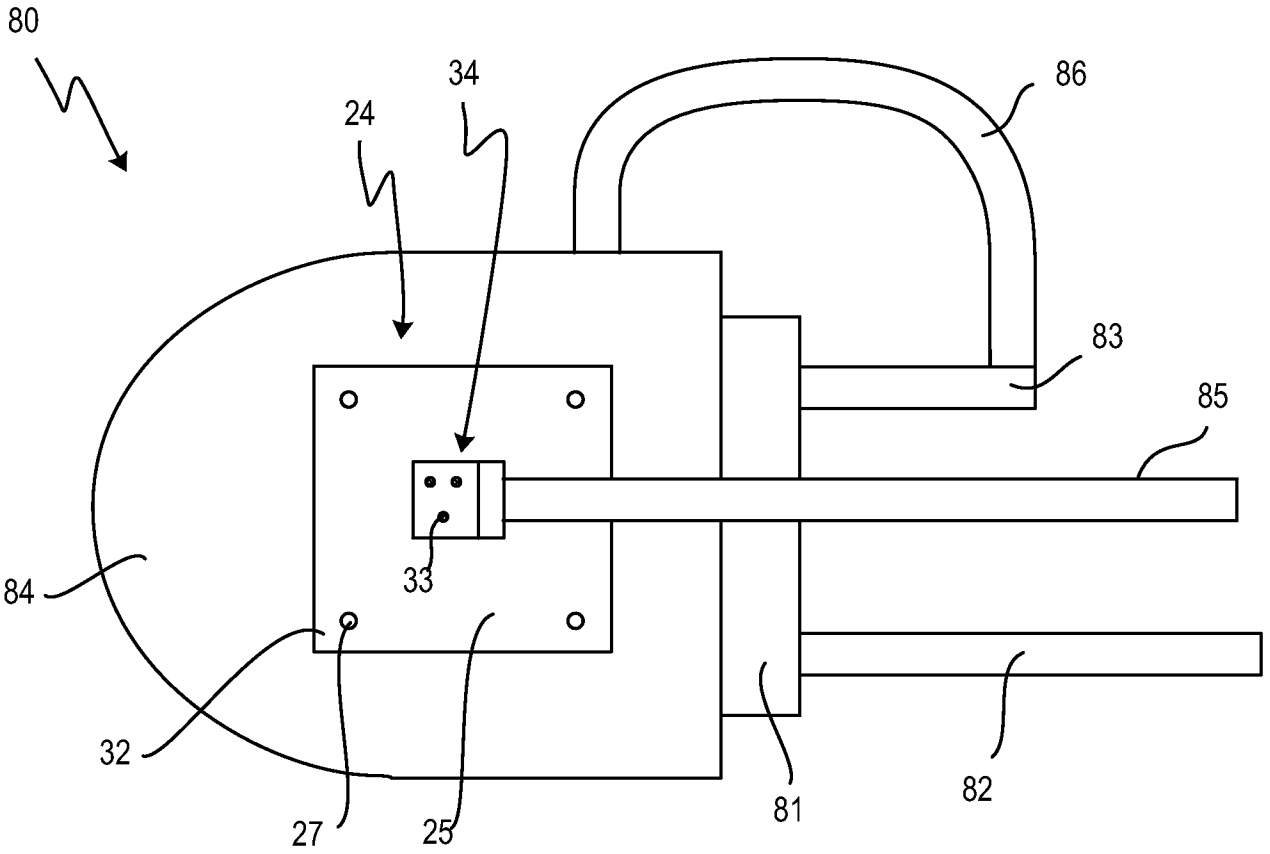
FIG. 5 shows a schematic plan view of a further temperature-dependent switch with welded-on heating resistor.

FIG. 5 shows a plan view of a further embodiment of a switch 80, which is equipped with a heating resistor 24 in the form of a metal part 25.

The switch 80 has an insulating base 81, out of which two connection electrodes 82, 83 protrude as connections. The base 81 is arranged in a metallic, electrically conductive housing 84, which has been pushed onto the base 81 as a cap. A temperature-dependent switching mechanism—masked by the housing 84 in the view of FIG. 5—is held on the base 81, as is shown by way of example in DE 195 09 656 A1, DE 10 2004 036 117 A1, DE 10 2008 031 389 B3 or DE 10 2011 016 896 B3.

The switching mechanism produces an electrically conductive connection between the two connection electrodes 82, 83 or opens the electrical connection depending on the temperature of said switching mechanism.

In order to provide the switch 80 with a defined current dependence, the metal part 25 is welded onto the housing 84 at the welding spots 27, as has been described above for the switches 10 and 40. In this embodiment, a connection electrode 85 is welded to the soldering angle 34.

The connection electrode 83 is electrically connected to the housing 84 via a connecting part 86; the connecting part 86 in this case performs the same function as the connecting part 74 in the case of the switch 40 from FIG. 4. The connecting part 86 is illustrated merely schematically in FIG. 5; any suitable configuration can be assumed.

It goes without saying that, instead of the connection electrodes 82, 83, 85, connection strands can also be used. In this case, if appropriate, the connecting part 86 can be dispensed with and one of the two connection strands provided on the switch as first connections can be connected directly to the housing.

The heating resistor 24 is thus connected electrically in series between the two first connections in the form of the connection electrodes 82 and 85 via the housing 84, the connecting part 86, the connecting electrode 83 and the temperature-dependent switching mechanism. It is used in a comparable manner to that of switch 40 for defined current-dependent switching.

Irrespective of the nature and design of the temperature-dependent switching mechanism, temperature-dependent switches with two first connections, between which the switching mechanism produces an electrical connection in temperature-dependent fashion, and with a housing which is electrically conductive in at least one section, can be equipped in the described manner by means of the metal part used according to the invention with a current-dependent switching function.

If the switch as such already switches in current-dependent fashion as well, this switching function can be configured in a more defined manner and improved by the metal part used in accordance with the invention.

Figure 6:
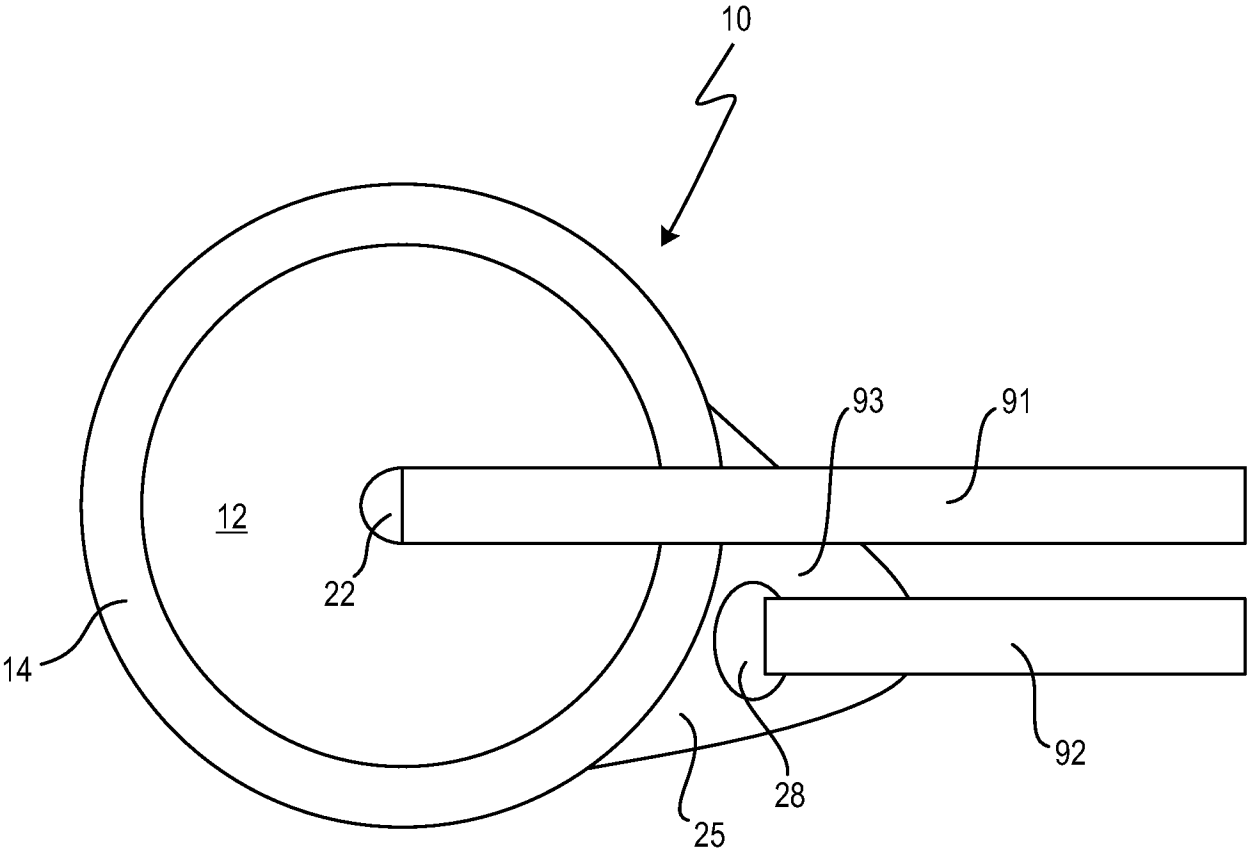
FIG. 6 shows a schematic plan view of yet a further temperature-dependent switch with welded-on heating resistor.

While, in the embodiments in FIGS. 1 to 5, the further connection 28 is arranged below the switch 10, 40, 80, i.e. within the contour thereof, FIG. 6 shows a plan view of an embodiment in which the metal part 25 protrudes laterally beyond the bottom 26 of the switch 10. A connection strand 91 is soldered to the first connection 22, and a further connection strand 92 is soldered to the further connection 28.

The metal part 25 is also in this case welded from outside to the bottom 26 of the switch 10, as is shown in FIGS. 1 and 2.

The metal part 25 in this case has a drop shape, and the further connection 28 in the embodiment shown in FIG. 6 is not centrally on the metal part 25 but is on a section 93 of the metal part 25 which, so to speak, forms the runout of the drop, i.e. where the metal part 25 protrudes laterally beyond the switch 10.

Therefore, what is claimed is:

1. A temperature-dependent switch comprising:

two first external connections for connecting said switch to an external circuit;

a temperature-dependent switching mechanism that depending on its temperature makes or interrupts an electrically conductive connection between said two first external connections;

a housing having an outside and accommodating said switching mechanism; and a heating resistor arranged on said outside of said housing and connected electrically in series with said two first external connections, said heating resistor being embodied as a sheet-metal part;

said sheet-metal part being welded to the housing, and a further external connection of said switch being provided directly on the sheet-metal part.

2. The switch of claim 1, wherein the housing comprises an upper part and a lower part and wherein at least the lower part is electrically conductive and is electrically connected to one of said two first external connections, the sheet-metal part being welded to an exterior surface of the electrically conductive lower part.

3. The switch of claim 2, wherein the upper part and the lower part of the housing are electrically conductive.

4. The switch according of claim 1, wherein the sheet-metal part is welded to the housing by at least two welding spots.

5. The switch according to claim 1, wherein said further external connection comprises a connection piece that is welded to the sheet-metal part.

6. The switch according to claim 5, wherein the connection piece is welded to the sheet-metal part by at least two welding spots.

7. The switch according to claim 1, wherein the sheet-metal part comprises a connection section that protrudes beyond the housing, said further external connection being provided at said connection section.

8. The switch according to claim 1, wherein the further external connection is arranged centrally on the sheet-metal part.

9. The switch according to claim 1, wherein the sheet-metal part has an ohmic resistance value as measured between the further external connection and the housing, said ohmic resistance value being less than 100 mΩ.

10. The switch according to claim 9, wherein the sheet-metal part has an ohmic resistance value as measured between the further external connection and the housing, said ohmic resistance value being between 2 and 50 mΩ.

11. The switch according to claim 1, wherein the sheet-metal part has a thickness of at least 50 μm.

12. The switch according to claim 2, comprising a stationary contact part fixedly connected to the upper part of said housing, wherein the switching mechanism comprises a movable contact part and a bimetallic snap-action disc that is mechanically connected to said movable contact part, when being at a temperature below its switching temperature, said bimetallic snap-action disc presses said movable contact part against said stationary contact part and, when being at a temperature above its switching temperature, said bimetallic snap-action disc lifts off said movable contact part from said stationary contact part, wherein the stationary contact part is connected to one of the two first external connections, and the switching mechanism is connected to the other of the two first external connections, at least when the movable contact part rest on the stationary contact part.

13. The switch according to claim 12, wherein the switching mechanism comprises a spring disc that preloads the movable contact part for resting on the stationary contact part, wherein the bimetallic snap-action disc lifts off the movable contact part from the stationary contact part when being at a temperature above its switching temperature.

14. The switch according to claim 1, comprising two stationary contact parts each being connected to one of the two first external connections, wherein the switching mechanism comprises a current transfer element that interacts with said two stationary contact parts.

15. The switch according to claim 14, wherein one of the two first external connections is electrically connected to the housing.

16. The switch according to claim 14, wherein the switching mechanism comprises a bimetallic snap-action disc that is mechanically connected to said current transfer element and presses said current transfer element against the two stationary contact parts when being at a temperature below its switching temperature, and lifts said current transfer element off from said stationary contact parts, when being at a temperature above its switching temperature.

17. The switch according to claim 16, wherein the switching mechanism comprises a spring disc that preloads said current transfer element for resting against said two stationary contact parts, wherein the bimetallic snap-action disc lifts off the current transfer element from the stationary contact parts when being at a temperature above its switching temperature.

18. The switch according to claim 1, which comprises an insulating base, said two first external connections being arranged on said insulating base, and the housing being plugged onto said insulating base.

19. The switch according to claim 18, wherein one of the two first external connections is electrically connected to the housing.

20. A temperature-dependent switch comprising two first external connections for connecting said switch to an external circuit, a temperature-dependent switching mechanism that depending on its temperature makes or interrupts an electrically conductive connection between said two first external connections, a housing having an electrically conductive section with an outside and accommodating said switching mechanism, and a heating resistor arranged at said housing and connected electrically in series with said two first external connections, said heating resistor comprising a sheet-metal part carrying a further external connection of said switch, said sheet-metal part being connected to said outside of said electrically conductive section of the housing by at least two welding spots.

21. A temperature-dependent switch comprising two first external connections for connecting said switch to an external circuit, a temperature-dependent switching mechanism that depending on its temperature makes or interrupts an electrically conductive connection between said two first external connections, a housing having an outside and accommodating said switching mechanism, and a heating resistor arranged on said outside of said housing and connected electrically in series with said two first external connections, said heating resistor being a sheet-metal part that is electrically and mechanically connected to said outside of the housing, said sheet-metal part having provided directly thereon a further external connection of said switch.

* * * * *